United States Patent [19]

Speer

[11] 4,345,578

[45] * Aug. 24, 1982

[54] BALL PROJECTING DEVICE CAPABLE OF PROVIDING SPIN

[75] Inventor: Richard A. Speer, Ware Neck, Va.

[73] Assignee: Apollo Systems, Inc., Cedar Falls, Iowa

[ * ] Notice: The portion of the term of this patent subsequent to Feb. 17, 1998, has been disclaimed.

[21] Appl. No.: 42,499

[22] Filed: May 25, 1979

Related U.S. Application Data

[63] Continuation-in-part of Ser. No. 929,675, Jul. 31, 1978, Pat. No. 4,250,862, which is a continuation-in-part of Ser. No. 894,162, Apr. 5, 1978, Pat. No. 4,212,284, which is a continuation-in-part of Ser. No. 764,197, Jan. 31, 1977, Pat. No. 4,094,294.

[51] Int. Cl.[3] ..... F41F 1/04

[52] U.S. Cl. ..... 124/56; 124/83

[58] Field of Search ..... 124/56, 80, 81, 83; 42/76 R

[56] References Cited

U.S. PATENT DOCUMENTS

| | | | |
|---|---|---|---|
| 2,460,924 | 2/1949 | Dally | 124/83 X |
| 3,329,063 | 7/1967 | Ehrenburg et al. | 46/76 R X |
| 3,847,132 | 11/1974 | Schatz | 124/81 X |
| 4,002,336 | 1/1977 | Beaver et al. | 124/56 X |
| 4,027,646 | 6/1977 | Sweeton | 124/56 |
| 4,054,120 | 10/1977 | Foley | 124/83 X |
| 4,073,280 | 2/1978 | Koehn et al. | 124/83 X |
| 4,094,294 | 6/1978 | Speer | 124/56 |

*Primary Examiner*—Richard T. Stouffer

*Attorney, Agent, or Firm*—Zarley, McKee, Thomte, Voorhees & Sease

[57] ABSTRACT

A ball projecting device, preferably pneumatically operated, is provided wherein the projected ball has "spin". The device comprises a projection tube including a curved portion, wherein the area of maximum curve radius of the curved portion, preferably is provided with a material having a high coefficient of friction; the ball is caused to roll along this high friction area, thereby imparting spin. The tube is preferably pivotable about two transverse axes, such that the elevation and spin-directing orientation of the tube end can be adjusted. The curved portion of the projection tube has a device for varying the radius of curvature from substantially infinite, i.e., a straight tube, to the desired minimum value.

14 Claims, 6 Drawing Figures

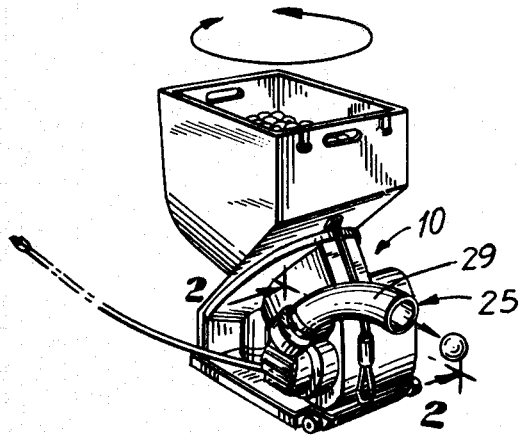
FIG. 1
FIG. 2
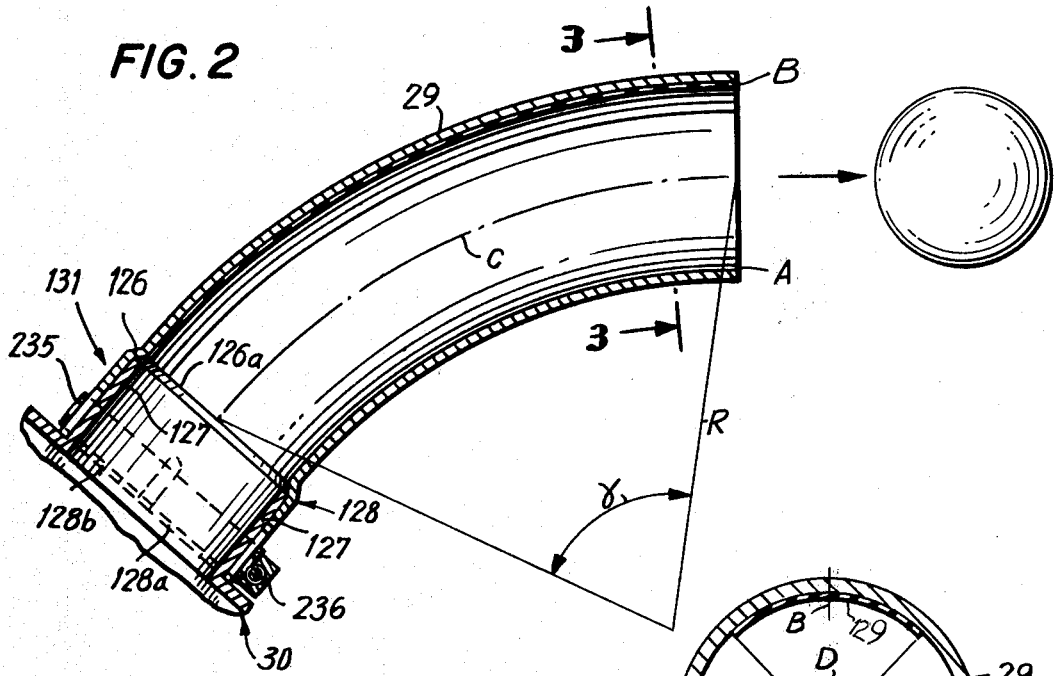
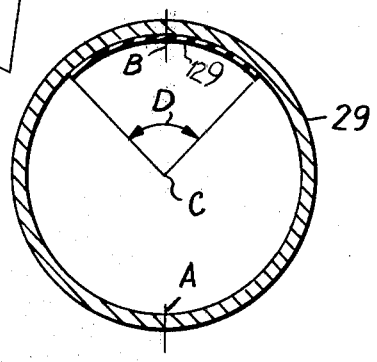
FIG. 3

BALL PROJECTING DEVICE CAPABLE OF PROVIDING SPIN

This is a continuation-in-part of copending application Ser. No. 929,675, filed on July 31, 1978, now U.S. Pat. No. 4,250,862, which is in turn a continuation-in-part of Ser. No. 894,162, filed on Apr. 5, 1978, now U.S. Pat. No. 4,212,284, which is in turn a continuation-in-part of application Ser. No. 764,197, filed on Jan. 31, 1977, and now U.S. Pat. No. 4,094,294.

This invention is directed to a device for the projecting or "throwing" of articles, and in particular to an improved, preferably pneumatically operated projecting device for the throwing of balls, such as tennis balls, baseballs and the like, which applies a spin to the projected ball.

The prior art is well acquainted with a variety of pneumatically operated devices for the serving of, especially, tennis balls, e.g., intended to provide the tennis player with the opportunity to practice ball return, especially after a serve. Although they are of varying effectiveness in mechanically providing a fascimile of the serve that a living partner would provide, they are generally unable to provide practice in returning that most difficult of shots, the ball with "spin".

It is an object of the present invention to provide an improved ball serving device which is capable of serving up a ball having applied "spin".

In accordance with the present invention, there is provided a device for projecting a ball from a barrel, wherein the projected ball has a rotational velocity, i.e., "spin", applied thereto. The ball can be rotated about several transversely aligned axes to provide what are commonly referred to as "top spin", "back spin", or "slice", which can have either left-handed or right-handed spin, or even combinations thereof, as can be provided by a player with a tennis racket, or by a baseball pitcher.

The ball projection device of this invention comprises a ball projection barrel having a curved tube portion. Preferably, a longitudinal strip of the internal surface of the curved tube portion intersecting the maximum curve radii of the tube is formed of a material having a relatively high coefficient of friction. The internal diameter of the curved tube is slightly larger than the ball passing therethrough such that there is a narrow air gap between the ball and the internal surface intersecting the minimum curve radii of the tube. The ball passing through the curved portion is pressed against the line of maximum curve radii by the action of so-called "centrifugal force"; the ball is caused to roll along the high friction surface, thus imparting a rotational velocity, or spin, to the ball when it passes out of the barrel. The curved portion is thus preferably the outermost portion of the barrel.

The energy for projecting the ball is preferably provided by pneumatic force as in the two parent cases, U.S. Pat. No. 4,094,294 and U.S. application Ser. No. 894,162. The curved portion of the barrel is preferably capable of being adjusted to different angles of elevation, i.e., relative to the horizontal. This can be provided, e.g., by a pivotal connection between the barrel and the rest of the mechanism.

A further understanding of the invention can be achieved from, and the preferred embodiments for achieving the desired objects are set forth in, the embodiments illustrated in the accompanying drawings.

The illustrated embodiments, however, are intended merely to be exemplary of the presently known preferred means for carrying out the invention, and are not intended to be exclusive of the full scope of the invention, which is defined by the appended claims.

Referring to the drawings:

FIG. 1 is a perspective view of the complete apparatus in operation;

FIG. 2 is an enlarged side elevation view along line 2—2 of FIG. 1;

FIG. 3 is a sectional view taken on line 3—3 of FIG. 2;

Figure 4:
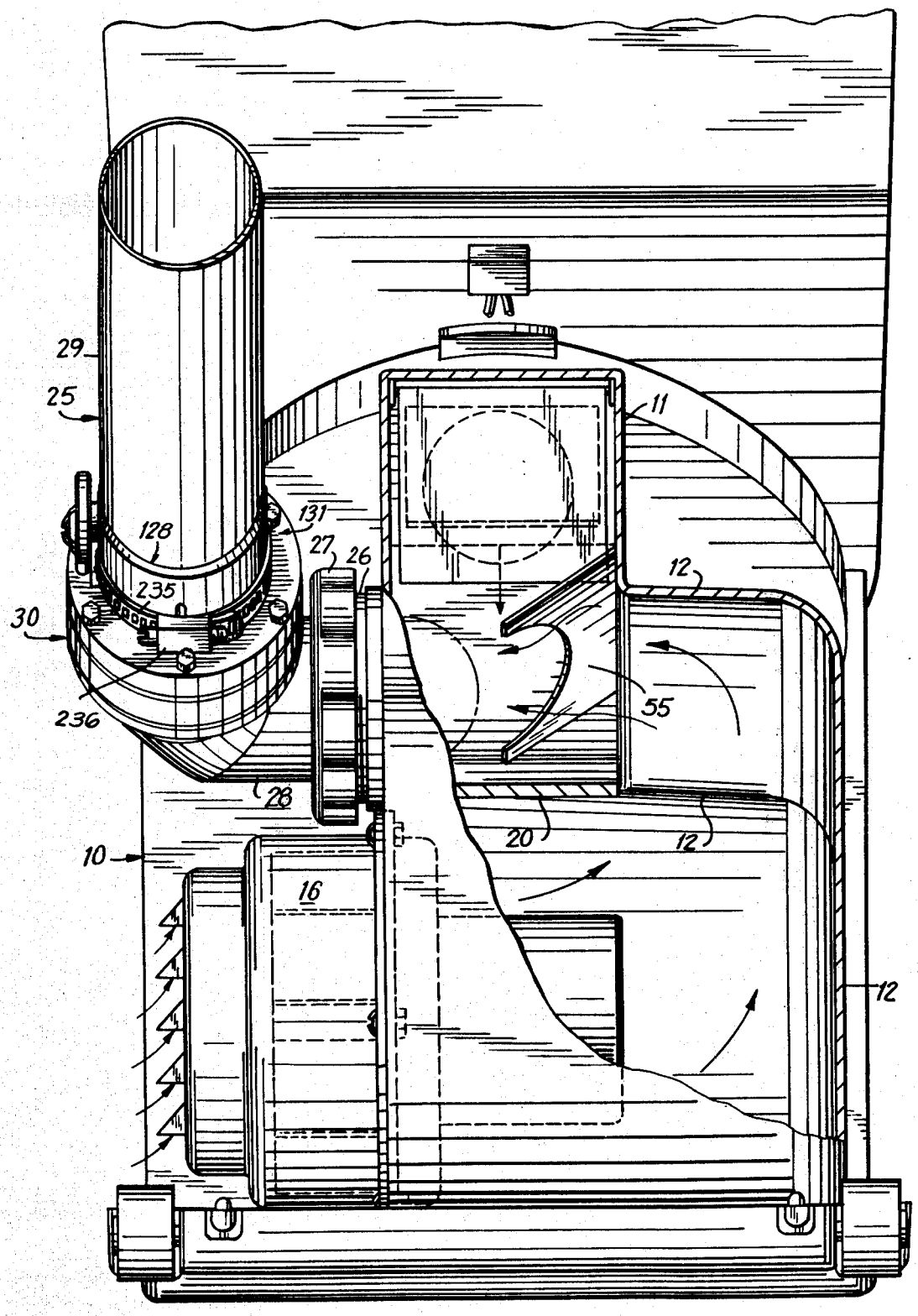
FIG. 4 is a partially broken away front elevation view of the complete device.

Referring to the drawings, FIGS. 1 and 4 depict the overall construction of a preferred ball serving or pitching machine in accordance with the present invention. Such a machine comprises, generally, a body portion, generally indicated by the numeral 10, including an air chamber lower portion 12, which in turn is in fluid flow connection with the output end of a blower 14, and an upper ball chute portion 11.

The angled barrel, generally indicated by the numeral 25, is rotatably connected to the body 10: an inner elbow 28 is rotatably joined to a knurled nut 27 which in turn is threadedly connected to a complementarily threaded barrel stub 26.

The barrel stub 26 is formed in the upper portion of the air chamber 12, substantially at the interface with the ball chute portion 11. The inner elbow portion 28 is connected to the outer curved barrel portion 29 of the barrel 25 via a flange member, generally indicated by the numeral 30.

The outer curved barrel 29, is connected to the flange 30, preferably by a locking taper joint or a threaded joint generally indicated by the numeral 131. A flange barrel stub 127 is secured to, or preferably formed integral with, the outer portion of the flange 30, and has at the end thereof a male tapered portion 126*a*. The curved barrel portion 29 has an expanded inner end 128 defining an internal matching female tapered portion 126 capable of being secured to the male portion 126*a* of barrel stub 127. To prevent rotation of the curved portion 29 relative to the stub 127, a conventional hose clamp 235 is applied around the expanded inner end 128. Segmented portions 128*a, b, c,* are formed along the edge of the expanded inner end 128.

The hose clamp 235, as shown is tightened by thumb screw 236 via a conventional worm gear mechanism. The clamp forces the segmented portions 128*a, b, c,* etc., together and tightly against the outer surface of the barrel stub 127. This is a sufficiently firm friction connection to secure the barrel at any orientation desired.

It is clear that in addition to tapered connections as shown, threaded joints or other means for connecting additional barrel lengths between the flange stub 127 and the curved barrel 29 are well-known in the art and can be equally well used. It is preferred that the interior diameter of the barrel remain substantially constant along its length, such that the barrel pieces be connected in a manner so as to maintain a substantially constant internal diameter of the barrel, or at least an inner barrel surface with no discontinuities, or sharp changes in internal diameter.

Internal diameter of the barrel is to be determined by the range of ball sizes within the nominally standardized range. For example, tennis balls vary depending upon manufacturing tolerances, age and degree of use, or wear. The barrel in a tennis ball service device, in accordance with this invention, should be sized to provide operating clearance for the largest new tennis ball.

The remaining portions of the mechanism and construction of the interior of the body 10 of the ball projecting device of this invention is substantially as described in copending application Ser. No. 894,162 filed Apr. 5, 1978, now U.S. Pat. No. 4,212,284 and/or in U.S. Pat. No. 4,094,294. Those portions of the above-identified copending application and patent which describe the interior of the body portion and its operation are incorporated herein by reference, as if fully set forth herein.

Preferably, means are provided for controlling the velocity of a ball projected from the barrel 25. Most preferred such means are shown in copending application Ser. No. 894,162, now U.S. Pat. No. 4,212,284. Other preferred means are shown in U.S. Pat. No. 4,094,294. Other means known to the prior art or to be developed in the future can be used to control velocity. Similarly, any pneumatic projection apparatus, or other type of projection apparatus, can be used as desired, especially where a projection force is continuously applied as the ball moves along the curved tube.

The curved barrel 29, is preferably formed by the arcs of circles, i.e., the circumferential line of minimum curve radius of the interior surface of the tube, indicated as A in FIG. 2, and the circumferential line of maximum curve radius, indicated as B in FIG. 2, are preferably arcs of substantially concentric circles. The difference between the radii of arcs A and B, is determined by the size of the balls to be projected. i.e., the distance between A and B. The length and the curve radius of the curved tube determine the degree of spin, i.e., rotational velocity imparted to a ball. Generally, for a given ball size, the larger the radius of curvature R, of the curved tube and the shorter the length L of the curved tube, the slower the rotational velocity of the ball leaving the barrel. The spin should preferably not be greater than can be achieved by a player. This, of course, depends upon the expertise of the user's anticipated opponents. The length of the tube 29 is most directly determined in terms of the degrees of arc the center line C subtends, i.e., $\nu$. As the rotational velocity of the spin on the projected ball decreases with increasing curve radius R, the spin can be tailored to the skill of the player by varying the curve radius or tube length. The length of the midline C is at least about $\nu=30°$.

The curve radius, R of the curved barrel 29, is preferably at least about eight times the radius of the ball, r.

A suitable "spin" for a tournament class tennis player can be achieved when $R=11$ and $\nu=45°$. For the novice tennis player, a suitable spin is achieved with $R=100\nu$ and $r=45°$, and most preferably R is not greater than about 125 r. For pitching a baseball, approximately the same values apply for a major leaguer and Little Leaguer, respectively.

Any given device is capable of handling a range of ball sizes, generally differing by as much as 10% in outside diameter. The largest ball to be used, however, should be slightly smaller than the internal cross-sectional diameter of the tube 29, such that the ball rolls along the line of maximum curve radius B, but does not touch the line of minimum curve radius, A.

To insure that the ball does not merely slide along the maximum curve line B, the interior surface of the tube 29 is preferably coated along the line B with a material 129 having a high coefficient of friction. The high friction material 129 is preferably applied along the full length of curved tube 29 over a portion of the internal surface, measured in angular terms, of preferably at least about 10° on either side of the line B of maximum curve radius, and generally not more than about 90° on either side of the line B. In the drawings, the angle D is optimally up to 90°.

Suitable such high friction materials for the coating 129 include the natural and synthetic rubbers, and especially neoprene. Other suitable materials can be used, if desired.

The remaining internal surface of the curved tube 29 is preferably formed of a relatively low friction material. Specifically, the curved tube 29 can be vacuum or pressure formed from, e.g., aluminum, and the inner surface formed as a relatively smooth, polished surface. Again, other suitable materials can be used, for example, other synthetic resins or metals.

The trajectory of the projected ball can be varied by rotating the inner elbow 28, about an axis transverse, to the longitudinal axis of the barrel 29 after loosening the knurled nut 27. The trajectory is fixed by tightening the nut 27 after setting the elbow 28 at the desired angle.

Figure 5:
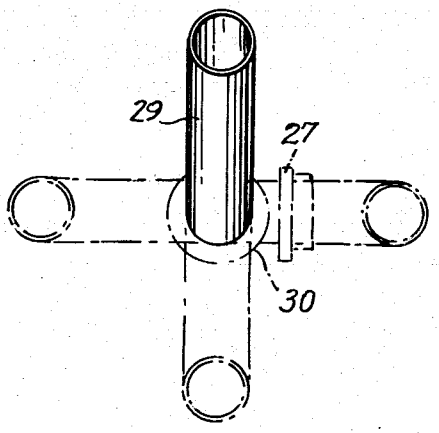
FIG. 5 is a diagrammatic depiction of the orientation of the curved barrel.

The direction of spin, i.e., the axis, or axes, of rotation of the projected ball is determined by the orientation of the curved barrel 29. Loosening the hose clamp 235, permits pivoting of the curved barrel 29, for example, as shown in FIG. 5, to different orientations.

The spin can be substantially infinitely adjusted by varying the orientation as desired. The orientation shown in solid lines in FIG. 5, provides a left-hand slice, with the ball spinning about a vertical axis. Rotating the curved barrel 29 by 180°, provides a spin about a vertical axis, but rotating in the opposite direction to provide a right-hand slice. A rotation of the curved barrel 29 of 90°, to the top position provides rotation about a horizontal axis, i.e., back spin, as shown in FIGS. 1 and 2; rotating to the lower position provides top spin. Positions intermediate to the pure horizontal or vertical orientation depicted in FIG. 5, provide combinations of spin and slice; for example, orienting the barrel 29 midway between the solid-line position in FIG. 5 and the top position, results in a ball projected with a spin about such a 45° axis, which will result in a certain amount of back spin and a certain amount of left-hand slice.

Figure 6:
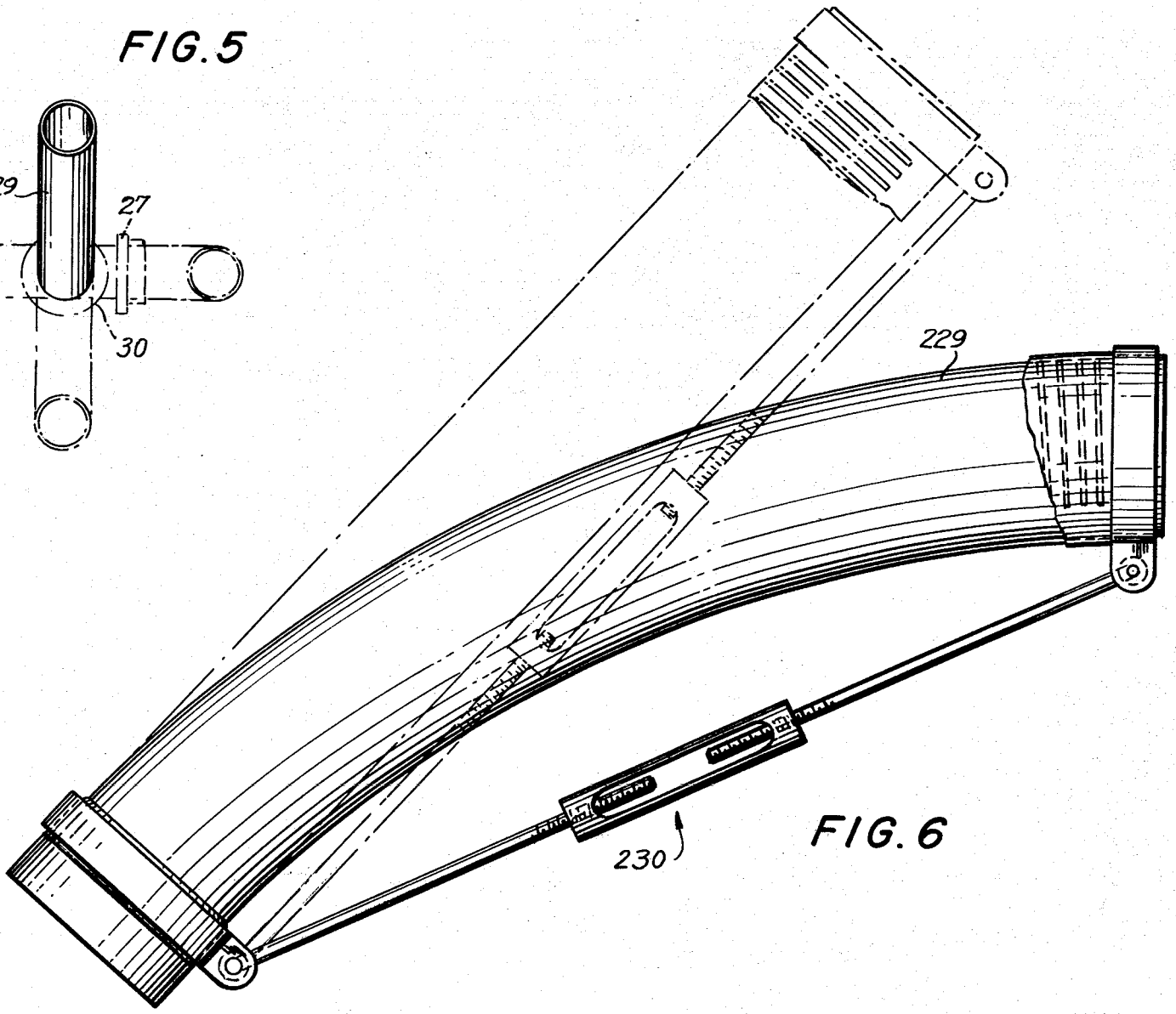
FIG. 6 is a cross-sectional view of a barrel with variable curvature.

FIG. 6 discloses a most preferred embodiment for providing a variable curvature to the barrel 229. The barrel 229 is a flexible member, which will bend evenly when the two ends are pulled together. The threaded tension device, generally indicated by the numeral 230, connected to the two ends of the tube, permit a substantially continuous range of curvature, from infinite radius, i.e., a straight line, to some desired minimum radius of curvature, e.g., as stated above.

The tube can be formed of, for example, flexible metal hose; vacuum line rubber hose or ribbed plastic pipe cut through along a line parallel to its longitudinal axis, the pipe being covered with a rubber boot to maintain air pressure as shown in FIG. 6; or flexible molded rubber hose.

The embodiments of the present invention which are claimed are as follows:

1. A device for projecting a ball, the device comprising a ball-directing tube having an internal circumference for confining and directing a ball to be projected, at least the outermost portion of the tube extending out to the muzzle being curved along the longitudinal extent thereof, said tube defining a midline along said longitudinal extent which is curved along a substantial portion of the tube's length, said midline having a radius of curvature no larger than 125 times the internal radius of the tube; gas pressure supply means in fluid flow connection with the tube to provide gas under pressure thereto; a first end to the tube being in fluid pressure connection to the pressure supply means; means for feeding a ball into the tube at the breech end thereof for movement along the tube in a direction from the first end of the tube toward the muzzle end of the tube and means for transiently developing gas pressure within the tube between the first end and the ball within the tube; the ball feeding means being capable of feeding a ball slightly smaller than the internal diameter of the curved portion of the tube; whereby a ball projected from the tube has a rotational velocity imparted thereto.

2. The device of claim 1 wherein the curved portion of the tube is pivotably connected to the pressure supply means, pivotable about the longitudinal axis of the tube, so as to change the orientation of the curved tube, whereby the direction of spin upon a projected ball can be varied.

3. The device of claim 2 wherein the first end of the tube is pivotably connected to the pressure supply means, pivotable about an axis transverse to the longitudinal axis of the tube, whereby the elevation of the tube can be varied.

4. The device of claim 1 comprising a longitudinal strip of high friction material along the line of maximum radius of curvature on the internal surface of the curved portion of the tube.

5. The device of claim 4 wherein the high friction material comprises a synthetic or natural rubber.

6. The pneumatic device of claim 5 wherein the friction material is neoprene.

7. The device of claim 4 wherein the transverse dimension of the friction material is defined by an angle of from about 20° to about 180°, extending along both sides of the line of maximum curve radius.

8. The device of claim 1, comprising means for securing the pivotable tube relative to the gas pressure supply means, whereby the angle at which the ball is projected can be established.

9. The device of claim 1, whereby the means of transiently developing gas pressure in the tube comprises detent means intermediate a curved portion of the tube and the gas pressure supply means, for transiently restraining the movement of a ball therethrough while forming a seal with the ball to prevent passage of gas therethrough.

10. The device of claim 9 wherein the detent means comprises an inflatable member within the ball-directing tube having means operatively connected to the pressure supply means for inflating the inflatable member and means to deflate the member, whereby a ball in the tube is restrained when the detent member is inflated and is permitted to pass through the tube when the detent member is in the deflated condition.

11. The device of claim 9 wherein the gas pressure supply means is an air compressing means having inlet means in fluid flow connection to the atmosphere and outlet means in fluid flow connection to the first end of the tube.

12. The device of claim 11 wherein the curved portion of the tube comprises substantially the arc of a circle.

13. A device for projecting a ball, the device comprising a ball-directing tube having an internal circumference for confining and directing a ball to be projected, at least the outermost portion of the tube extending out to the muzzle being curved; the curved portion of the tube being formed of a flexible member and having connected thereto means for varying the radius of curvature of the curved portion of the tube; gas pressure supply means in fluid flow connection with the tube to provide gas under pressure thereto; a first end of the tube being in fluid pressure connection to the pressure supply means; means for feeding a ball into the tube at the breech end thereof for movement along the tube in a direction from the first end of the tube toward the muzzle end of the tube; and means for transiently developing gas pressure within the tube between the first end and the ball within the tube; the ball feeding means being capable of feeding a ball slightly smaller than the internal diameter of the curved portion of the tube; whereby a ball projected from the tube has a rotational velocity imparted thereto.

14. The device of claim 13 wherein the radius of curvature-varying device comprises inextensible connecting means extending from one end of the curved portion of the barrel to the second end of the curved portion of the barrel, and adjusting means for adjusting the inextensible length of the connecting means.

* * * * *